United States Patent [19]

Kosaka

[11] Patent Number: 4,771,797

[45] Date of Patent: Sep. 20, 1988

[54] STEAM HAIRSETTER

[75] Inventor: Genzi Kosaka, Nara, Japan

[73] Assignee: Sharp Kabushiki Kaisha, Osaka, Japan

[21] Appl. No.: 77,990

[22] Filed: Jul. 24, 1987

Related U.S. Application Data

[63] Continuation of Ser. No. 714,078, Mar. 20, 1985, abandoned.

[30] Foreign Application Priority Data

| | | | |
|---|---|---|---|
| Apr. 26, 1984 | [JP] | Japan | 59-63168[U] |
| Apr. 26, 1984 | [JP] | Japan | 59-63169[U] |
| Apr. 26, 1984 | [JP] | Japan | 59-63170[U] |
| Apr. 26, 1984 | [JP] | Japan | 59-63171[U] |
| Apr. 26, 1984 | [JP] | Japan | 59-63172[U] |

[51] Int. Cl.[4] ..... A45D 2/36

[52] U.S. Cl. ..... 132/272; 132/272; 132/228

[58] Field of Search ..... 132/36 R, 36 AA, 33 R, 132/36 CC; 219/222, 225, 226, 227

[56] References Cited

U.S. PATENT DOCUMENTS

| | | | |
|---|---|---|---|
| 3,614,381 | 10/1971 | Popeil | 132/33 R |
| 3,646,316 | 2/1972 | Volosin et al. | 132/33 R |
| 3,700,853 | 10/1972 | Jensen et al. | 132/33 R |
| 3,749,106 | 7/1973 | Kelmann et al. | 132/33 R |
| 3,768,491 | 10/1973 | Barradas | 132/36 R |
| 3,858,029 | 12/1974 | Walter | 132/33 R |
| 4,298,787 | 11/1981 | Barradas | 132/36 R |
| 4,516,011 | 5/1985 | Jeffress et al. | 132/33 R |

*Primary Examiner*—Robert Peshock
*Assistant Examiner*—J. Hakomaki
*Attorney, Agent, or Firm*—Flehr, Hohbach, Test, Albritton & Herbert

[57] ABSTRACT

A steam hairsetter includes a steam generator and a water device for supplying a predetermined amount of water to generate a desired amount of steam when a hair curler is installed at the steam outlet of the steam generator.

14 Claims, 7 Drawing Sheets

STEAM HAIRSETTER

This is a continuation of application Ser. No. 714,078 filed Mar. 20, 1985, now abandoned.

BACKGROUND OF THE INVENTION

This invention relates to a means for generating steam and more particularly to a steam generator for a steam hairsetter adapted to heat hair curlers.

A steam hairsetter of a conventional design is shown in FIGS. 12 and 13. A steam generator 17 comprises an outer housing 11 which forms a water tank 16, an inner housing 3 with a large number of openings 2 in its bottom section 1, heater electrodes 6 and 7 connected to a power cord 5 which penetrates a cord bushing 4, and a cover 9 with an opening 8. The cover 9 is attached to the outer housing 11 by a screw means 10 and has a protruding section 15 on which is a table means 14 for carrying a hair curler 13. No. 12 generally shows openings in the table means 14. When water 18 is heated inside the tank 16 by the heater electrodes 6 and 7, steam is generated and ejected as shown by the arrows 19 through the openings 8 and 12. The curler 13 is heated thereby and provides appropriate temperature and humidity to the hair wound around it.

One of the disadvantages of the conventional steam hairsetter described above is that steam 19 is not generated instantly because the entire body of water 18 inside the tank 16 must be heated first. Moreover, the impurities contained in the water 18 cause irregularities in power consumption rate, preventing efficient generation of steam. Thus, it takes a long time to heat the curler 13, wasting the user's time.

SUMMARY OF THE INVENTION

It is therefore an object of the present invention to provide a steam generator for a steam hairsetter without the aforementioned drawbacks.

The above and other objects of the present invention are achieved by an improved steam hairsetter provided with a means for supplying a predetermined amount of water so that a specified amount of steam is generated by a steam generator when a curler is set at the opening for the steam.

DETAILED DESCRIPTION OF THE INVENTION

Figure 1:
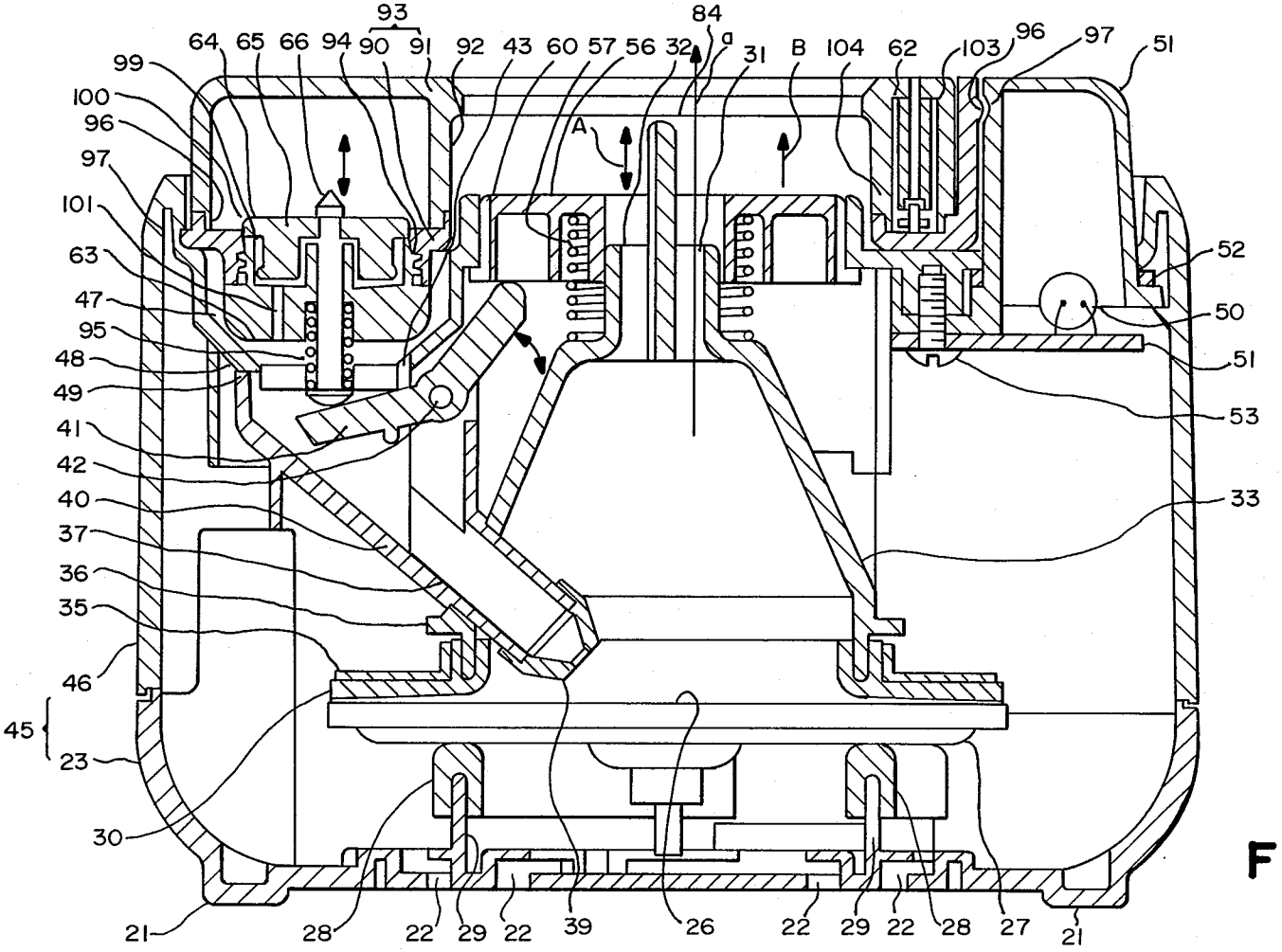
FIG. 1 is a cross-sectional view of a portion of a steam hairsetter embodying the present invention.
Figure 2:
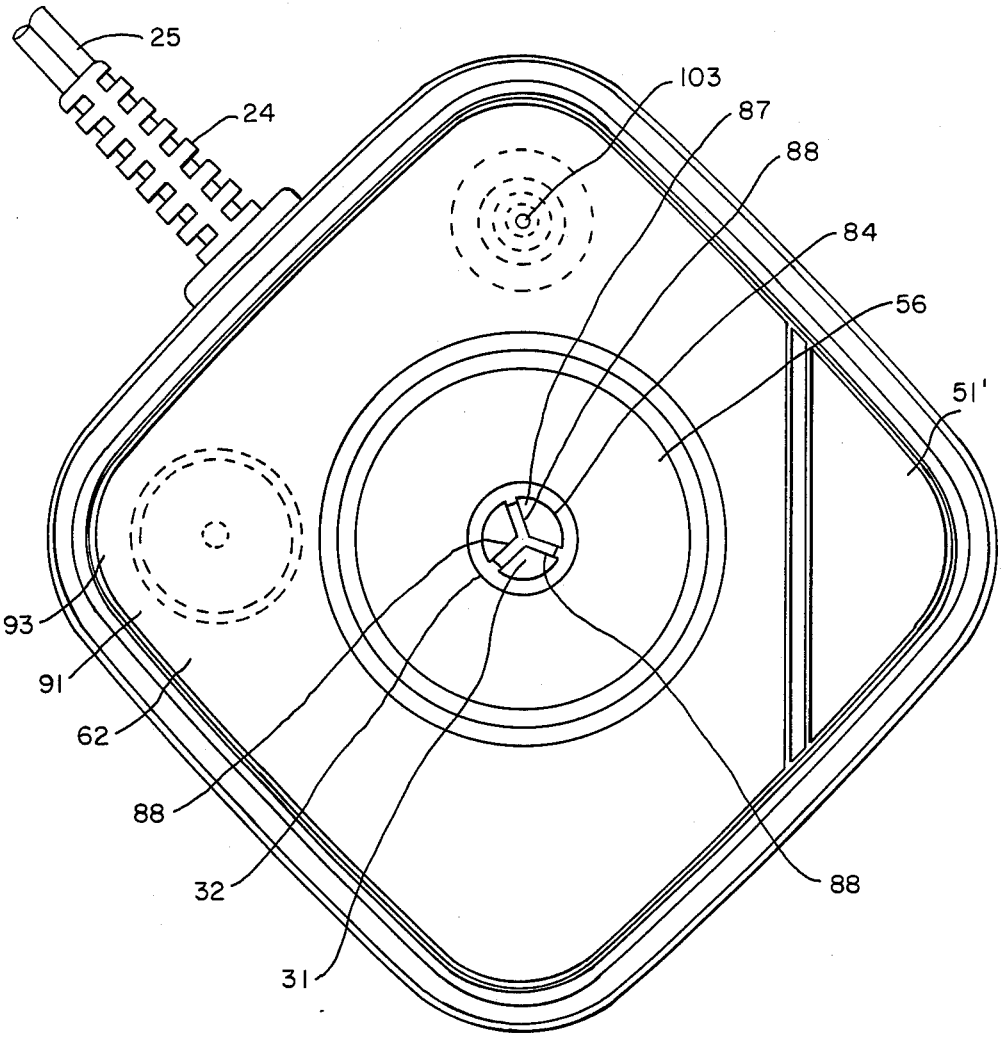
FIG. 2 is a plan view of the portion of the steam hairsetter shown in FIG. 1.
Figure 3:
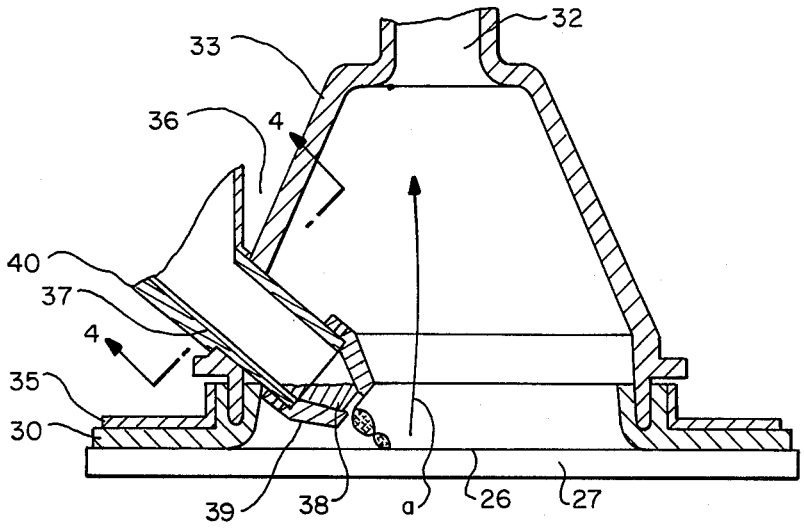
FIG. 3 is a cross-sectional view of a portion of the steam generator shown in FIG. 1.
Figure 4:
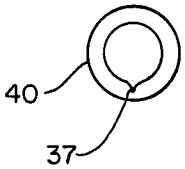
FIG. 4 is a cross-sectional view of the portion of the steam generator shown in FIG. 3 taken along line 4—4 in the direction of the arrows.

There is shown in FIGS. 1 through 11 an example of a steam hairsetter using a steam generator of the present invention. A heater 27 is supported by jigs 28 and jig support means 29, and comprises a thermostat (not shown) which is connected by a power supply cord 25 passing through cord bushing 24 to a lower housing 23 having legs 21 and air passage holes 22. The heater 27 further comprises a positive thermister formed on a heating surface 26 which has either a spiral, radial or meshed pattern so that water droplets are efficiently dispersed over its surface and the heating area can be increased. A drum (a cover means) 33 which has steam tubing 32 equipped with steam holes 31 is installed above the heater 27 with press packing 30. Plates 35 press the packing 30 against the heater 27 so that the drum 33 and the heater 27 are sealingly pressed against each other to configure a steam generator 36 without allowing water or steam to leak out. A water supply pipe 40 is affixed to the drum 33 at a predetermined position. At one end of the water supply pipe 40, there is a V-shaped groove 37 on the inner surface so that water can flow smoothly therethrough. The same end of the water supply pipe 40 is also provided with a cap 39 adapted to retain a small amount of water and surface tension of this residual water is utilized to close up this end. There is a lever 41 rotatably mounted at another predetermined point on the water supply pipe 40, at the other end of which is an inserting means 43 passing through one end of the lever 41. The top end of the water supply pipe 40 has a connecting means 49 which engages with a similar connecting means 48 of a tank installation part 47. The tank installation part 47 is on an upper housing 46 which attaches to the lower housing 23. The combination of the upper housing 46 and the lower housing 23 is designated by the numeral 45. A neon lamp 50 for indicating whether the heater power is on and other electrical parts are set on a printed circuit board 51. A lamp cover 51' for the lamp 50 and the printed circuit board 51 are affixed by screw means 53 to the upper housing 46 through a packing means 52. A curler installation part 56 for a hair curler 55 is slideably mounted on the steam tubing 32 of the drum 33 in the directions of arrows A in FIG. 1 with a spring 57 supplying an upward force constantly to the part 56 as shown by arrow B. A bottom surface 60 of the part 56 is in contact with an end of the lever 41 so that the part 56 will not become disengaged form the steam tubing 32. The water supply pipe 40 and the tank installation part 47 are connected through the connecting means 48 and 49. The upper housing 46 and the lower housing 23 are engaged and a water supply tank 62 is attached to the part 47 of the upper housing 46 so that an axial opener 66 of a water supply control valve 65 which is a part of a water supply control mechanism 64 for a tank cap 63 is in contact with the other end of the lever 41.

More in detail, the thermostat is for preventing the heater 27 from overheating in case of malfunctioning, and is affixed to it by a thermally conductive adhesive material. The drum 33 is made of a material with a large coefficient of thermal expansion so that the steam generated by the heater 27 will cause it to expand, compressing the packing 30 tightly between the heater 27 and the drum 33, forming a perfect seal and causing the steam ("a" in FIG. 3) to be discharged efficiently from holes 31 on the drum 33 without leaking into the interior of the housing 45.

Figure 5:
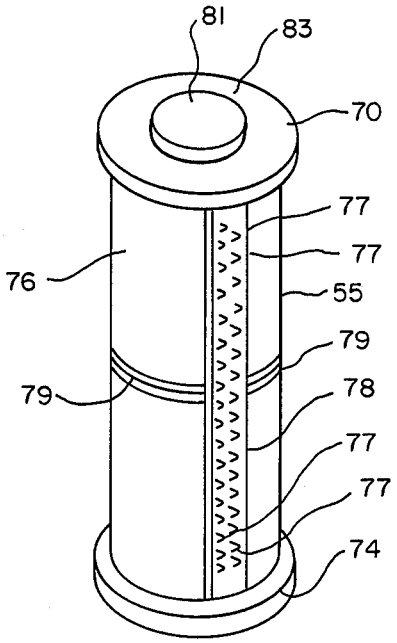
FIG. 5 is a perspective view of a portion of a curler according to the present invention.
Figure 6:
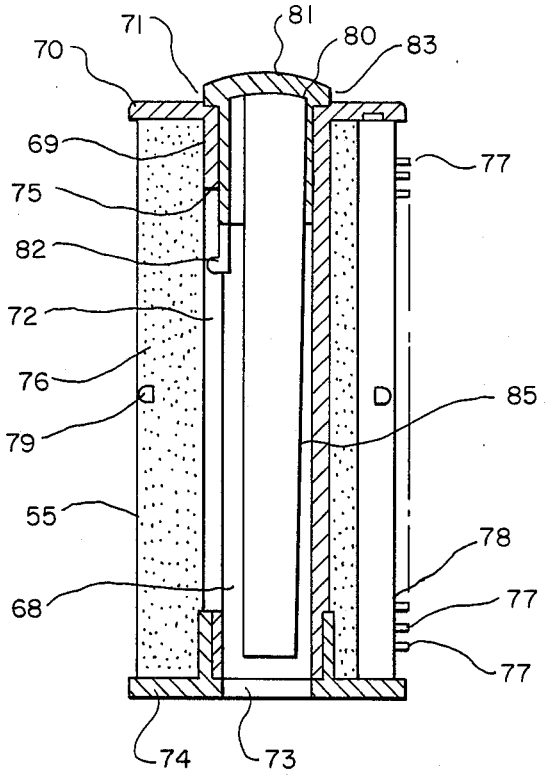
FIG. 6 is a longitudinal cross-sectional view of the curler of FIG. 5.
Figure 7:
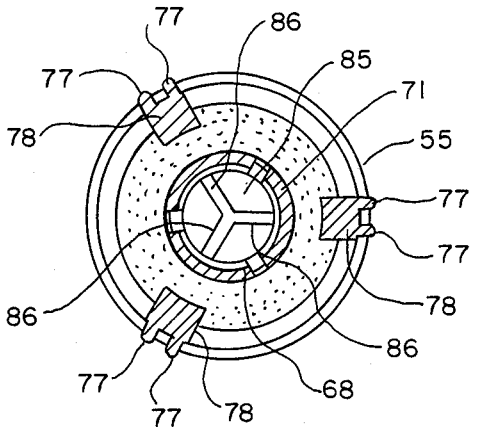
FIG. 7 is a transverse cross-sectional view of the curler of FIG. 5.

The structure of the curler is shown in FIGS. 5 through 7. A bobbin 71 which is a one-piece structure made of polypropylene, for example, has a cylindrical part 69 and a brim 70. An appropriate number of steam discharge holes 27 are provided on the cylinder 69 at predetermined locations so as to be in communicating relationships with steam supply holes 68. Another brim 74, which encloses a steam supply opening 73, is attached to the bottom of the cylinder 69. A foam material 76 which is permeable to air and capable of retaining moisture is wrapped around the outer circumferential surface 75 of the cylinder 69. Hair hooks 78, each including hair hooking protrustions 77, are attached between the brims 70 and 74. A means 79 for supporting the hair hooks 78 at predetermined positions is attached to the centers of the hair hooks 78. A block 80 adapted to protrude from the holes 68 by a predetermined amount is attached thereto. A grip 81 is provided at the top end of the block 80. A blocking body 83 including elastic hook 82 adapted to hook onto the holes 72 when the body 83 protrudes from the holes 68 by a predetermined amount is slideably attached to the bottom end of the block 80. A protrusion 85 is affixed on the back of the grip 81 of the blocking body 83 so that the installation of the brim 74 onto the part 56 of the hair curler 55 causes the brim 74 to contact a protrusion 84 from the steam generator 36, thereby causing the blocking body 83 to move inside the holes 68 and to protrude by a predetermined amount. Guide surfaces 86 are provided for directing the flows of steam "a" from the holes 31. If the holes 72 are provided in three equally spaced directions regarding the bobbin 71, for example, these surfaces 86 must also be so arranged that the steam "a" will be guided in these three directions. The flows of steam can be more dependably directed into the desired directions if guide surfaces 88 are provided so that steam is also directed to the outer surfaces 87 of the protrusion 84.

Figure 8:
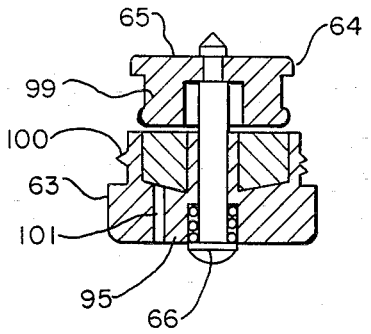
FIGS. 8 and 9 show the operation of the valve in the water supply control mechanism of the steam hairsetter of FIG. 1.
Figure 9:
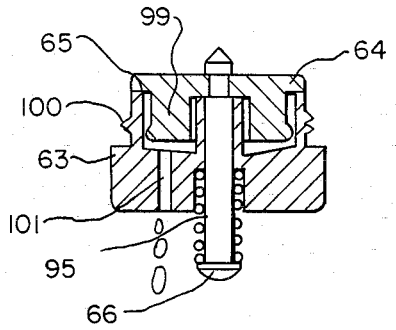
Figure 10:
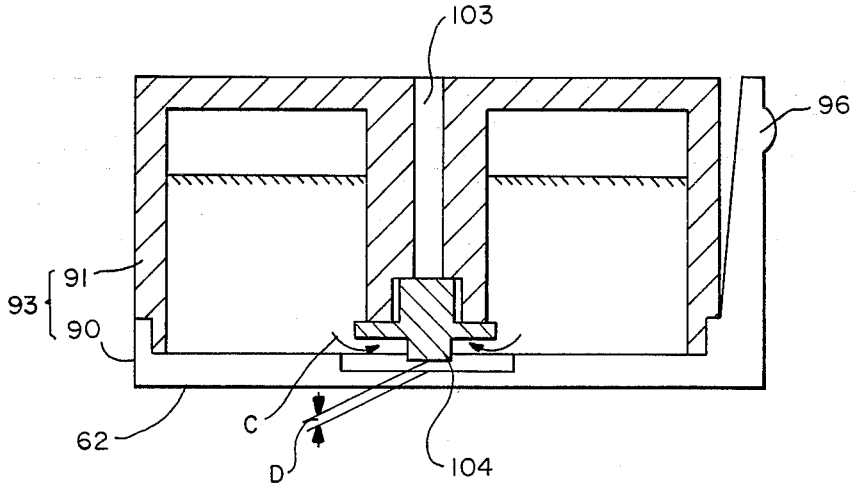
FIG. 10 is an enlarged cross-sectional view of the air passage section of the water tank of the steam hairsetter of FIG. 1.
Figure 11:
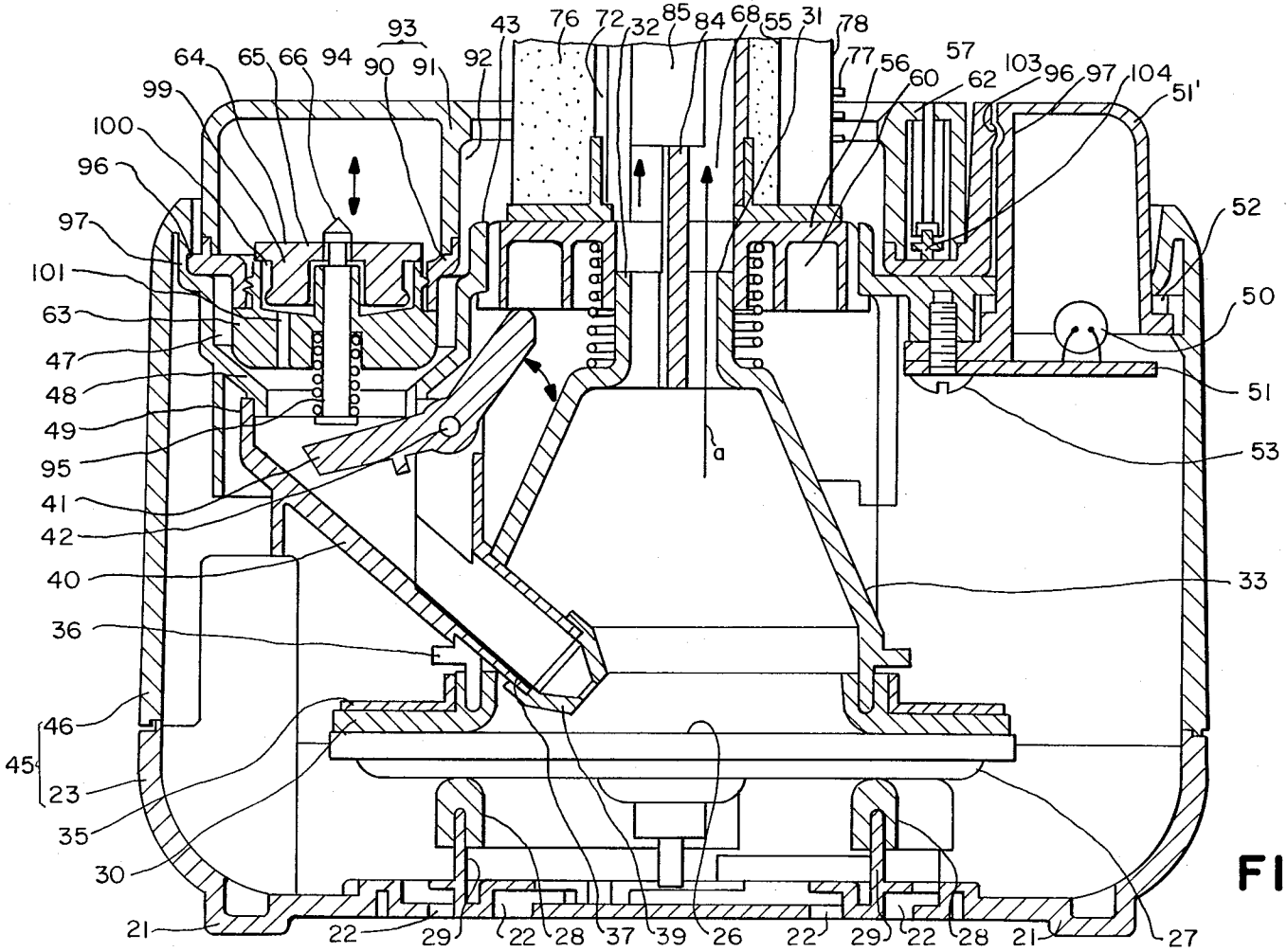
FIG. 11 is a cross-sectional view of the steam hairsetter of FIG. 1 for showing how it is used.
Figure 12:
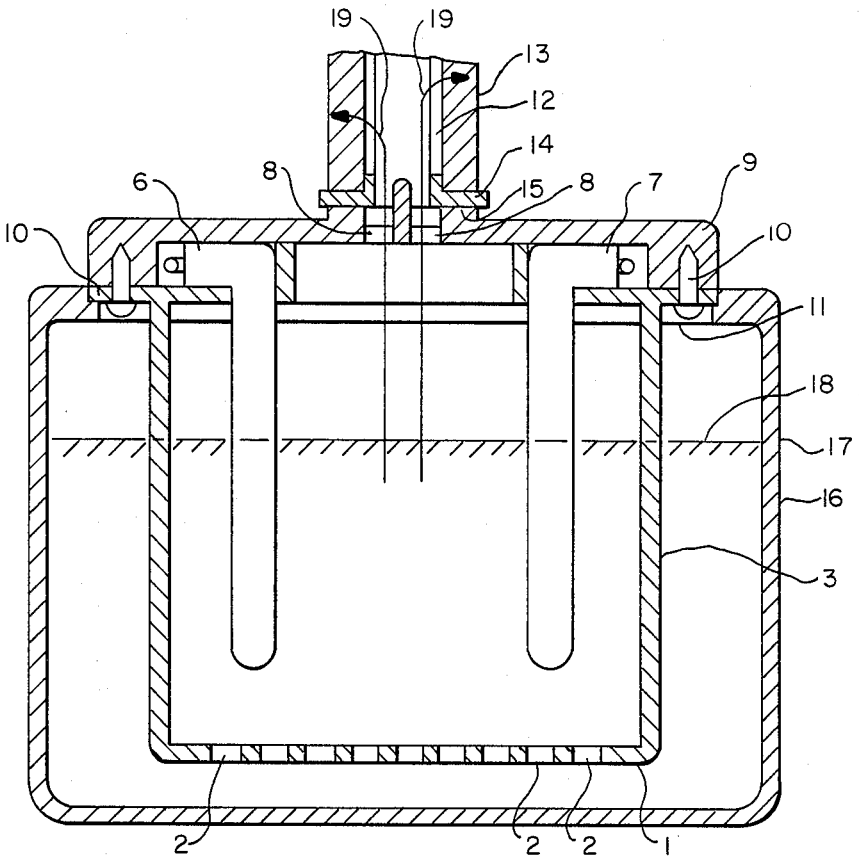
FIG. — 12 PRIOR ART
FIG. 12 is a cross-sectional view of a portion of a conventional steam hairsetter.
Figure 13:
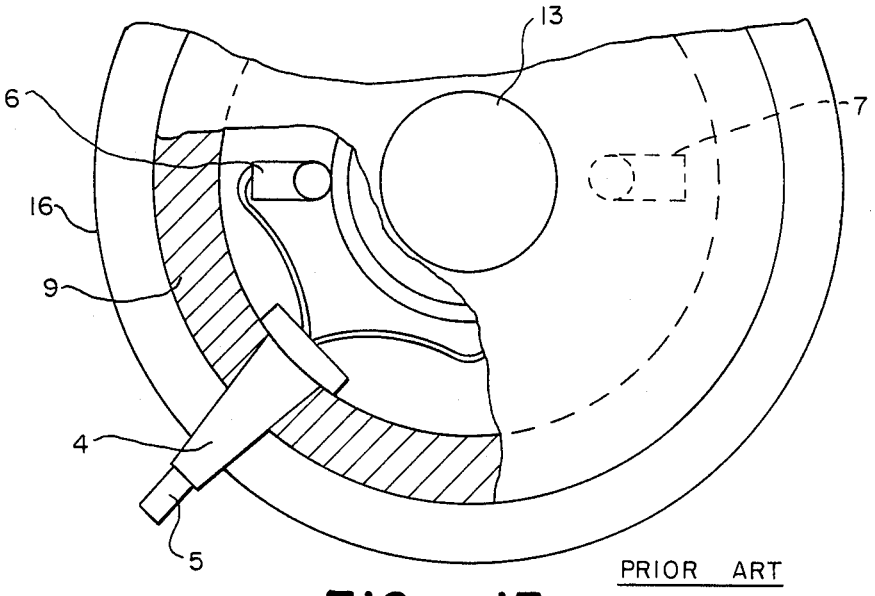
PRIOR ART FIG. — 13
FIG. 13 is a partially sectional plan view of the conventional steam hairsetter of FIG. 12.

The water supply tank 62 comprises a main body 93 consisting of a ring-shaped bottom section 90 and a ring-shaped upper part 91, as best shown in FIG. 10, defining a central cavity 92. A water supply orifice 94 is provided at a predetermined position on the main body 93. The tank cap 63 is removably mounted onto the orifice 94 and includes the water supply control valve 65, a spring 95 and the water supply control mechanism 64. The spring 95 supplies a constant pressure to the valve 65 while the mechanism 64 includes the axial opener 66 for opening the valve 65 by operating the lever 41. The bottom section 90 of the tank 62 is provided with a plurality of engaging protrusions 96 while engaging indentations 97 are provided to the lower housing 23 and to the lamp cover 51' so that these protrusions 96 and indentations 97 engage together, thereby affixing the main body 93 of the tank 62 to the housing 45. The water supply control mechanism 64 of the water supply tank 62 is further provided with a piston 99 for the valve 65 while the tank cap 63 is equipped with a cylinder 100 as shown in FIGS. 8 and 9. The cylinder 100 slideably encloses the piston 99. The tank cap 63 also has a connecting hole 101 linking the cylinder 100 to the exterior of the tank cap 63. The piston 99 is caused to slide inside the cylinder 100 by the water supplied from the tank 62 through the cylinder 100 when the valve 65 is opened and closed. A predetermined amount of water (or the amount supplied to the cylinder 100) is pushed outside through the hole 101 and this supplying of water stops when the hole 101 is closed by the valve 65. As shown in FIG. 10, furthermore, the water supply tank 62 is also provided with a ventilation hole 103 for air and a float 104 located immediately below the hole 103. The hole 103 becomes closed by the weight of the float 104 when the tank 62 is turned upside down. When the piston 99 is moved to increase the pressure inside the cylinder 100, a water pressure is applied against the bottom of the float 104 as shown by arrow C in FIG. 10, closing the hole 103 to prevent water leakage from the tank 62 through the hole 103. In FIG. 10, D indicates the distance by which the float 104 is moved by its own weight.

When the steam hairsetter described above is used, the water supply tank 62 containing the designated amount of water is installed on the tank installation part 47 of the upper housing 46 so that the opener 66 of the valve 65 touches one end of the lever 41. The power supply cord 25 is connected to a power source and power is supplied to the heater to heat the steam generator 36. The hair curler 55 is mounted on the installation part 56 so that the steam supply holes 68 of the hair curler 55 match the steam holes 31 of the steam generator 36. The protrusion 85 of the hair curler 55 is kept in contact with the protrusion 84 of the steam generator 36 and the hair curler 55 is pushed down against the upward force of the spring 57 on the part 56. When the part 56 is caused to slide down, the protrusions 84 and 85 are pressed against each other, causing the blocking body 83 of the hair curler 55 to slide inside the steam supply holes 68 and to protrude therefrom by a predetermined amount. This downward movement of the part 56 causes one end of the lever 41 to move down and the other end thereof in contact with the opener 66 to move upward. The upward movement of the opener 66 opens the valve 65, causing the water in the tank 62 to flow into the cylinder 100. An upward sliding motion of the part 56 results by the force of the spring 57 when the pressure thereon from the curler 55 is released, closing the valve 65. This causes the piston 99 to slide inside the cylinder 100 and the water contained in the cylinder 100 pushes out a predetermined amount of water from the tank cap 63 through the hole 101. This predetermined amount of water passes through the pipe 40 and is fed to the heating surface 26 of the steam generator 36, becoming heated thereby and converted instantly into steam. Steam "a" passes through the holes 31 and to the steam supply holes 68 of the hair curler 55. Upon emerging from the holes 68, steam "a" then passes through the discharge holes 72 and is fed to the foam material 76 of the hair curler 55. Both the foam material 76 and the hair curler 55 are thereby humidified and heated to desired levels. Hair is wrapped around the hair hooks 78 and the heat and humidity necessary for hair setting are provided to the hair.

In summary, the water tank 62 is securely installed onto the part 47 of the upper housing 46 by means of the engagements between the indentations 97 and the protrusions 96 so that the installation can withstand external impacts. As for the mechanism for supplying a predetermined amount of water to the heating surface 26 in the steam generator 36, or to generate a desired amount of steam, the predetermined amount of water defined by the capacity of the cylinder 100 is first supplied into the cylinder 100 by opening the valve 65, or by the pressure exerted on the installation part 56 by the hair curler 55. When this pressure is released, the piston 99 moves inside the cylinder 100 and pushes out the predetermined amount of water through the connection hole 101, the water supply pipe 40 and the cap 39 onto the heating surface 26. This results in the desired generation of the predetermined amount of steam "a" by the steam generator 36. Moreover, the water supply pipe 40 is provided with a V-shaped groove 37 so that water can smoothly flow therethrough, and the heating surface 26 has a rough finish so as to increase the effective heating surface area. The water supplied to the surface 26 is prevented form forming droplets by surface tension and is caused instead to spread uniformly over the entire area for more efficient heating. On the other hand, the surface tension of the residual water 38 closes the tip of the cap 39 so that the steam "a" from the steam generator 36 cannot flow back through the cap 39 into the water supply pipe 40. Thus, the generated steam is entirely led to the hair curler 55 through the holes 31. When the hair curler 55 is pushed onto the part 56, furthermore, the blocking body 83 protrudes beyond the holes 68 by a predetermined amount. When the hair curler 55 is heated and humidified to predetermined levels, it can be removed from the installation part 56 by holding the grip 81 of the blocking body 83. As a result, fingers do not become exposed to the steam "a" during the removal of the hair curler 55 from the part 56 and hair can be easily wrapped around the hair curler 55. Since the hole 103 is dependably opened and closed by the float 104, there will be neither any unintended air flow to the tank 62 through the hole 103 nor any unintended water leakage from the tank 62.

Although the water supply pipe cap 39 is affixed at a predetermined position to one end of the water supply pipe 40 according to the embodiment described above, an integral blocking section that is operated by residual water 38 at a predetermined position may be formed. Moreover, the steam generator described herein may be used as a part of a humidifier rather than with a steam hairsetter. In short, the scope of this invention is limited only by the following claims.

What is claimed is:

1. A steam hairsetter comprising a steam generator with a steam discharge opening, a normally closed valve means for supplying a predetermined amount of water to said steam generator, and a curler table near said steam discharge opening for mounting a curler thereon by displacing said curler table from a normal position thereof to a mounted position against a biasing force, said curler table and said valve means being so connected that said valve means is opened in response to displacement of said curler table from said normal position to said mounted position, thereby supplying said predetermined amount of water to said steam generator.

2. The steam hairsetter of claim 1 wherein said valve means comprises a piston means and a cylinder means.

3. The steam hairsetter of claim 1 wherein said steam generator comprises a water supply tank for supplying water to a heating surface, said tank having a ventilation hole, and a float adapted to open and close said hole.

4. The steam hairsetter of claim 1 further comprising a heating surface, a water supply pipe for supplying said predetermined amount of water to said heating surface, a blocking means in said water supply pipe, said blocking means adapted to block said water supply pipe by residual water after a supply of water is made, thereby preventing backward flowing through said water supply pipe of steam which was generated when said predetermined amount of water was supplied to said heating surface.

5. The steam hairsetter of claim 1 further comprising a heating surface and a water supply pipe for supplying said predetermined amount of water to said heating surface, there being a V-shaped groove on the inner surface of said water supply pipe so that water can flow to said heating surface smoothly therethrough.

6. The steam hairsetter of claim 1 further comprising a spring which supports said curler table, supplying said biasing force to normally keep said curler table in said normal position.

7. The steam hairsetter of claim 1 further comprising a lever rotatably supported around an axis, one end of said lever being in contact with said curler table and the other end thereof being directly in force-communicating relationship with said valve means.

8. The steam hairsetter of claim 1 wherein said curler table is disposed around said steam discharge opening.

9. A steam hairsetter comprising a steam generator having a heating surface for heating water thereon to generate steam and steam discharge openings for discharging said generated steam, a tank with a cylinder for storing water, a valve with a piston adapted to slidingly move inside said cylinder, said valve being normally closed between said tank and said cylinder by a biasing force, a curler table disposed near said discharge opening, said table being adapted to move from a normal position to a compressed position as a curler is mounted on said table, and a mechanism connecting said valve and said table such that said valve opens and water flows from said tank into said cylinder as said table is moved to said compressed position, said piston being adapted to push a predetermined amount of water from inside said cylinder to said heating surface as said valve is closed by said biasing force.

10. The steam hairsetter of claim 9 further comprising a water supply pipe for supplying said predetermined amount of water to said heating surface, a blocking means in said water supply pipe, said blocking means adapted to block said water supply pipe by residual water after water is supplied through said water supply pipe, thereby preventing backward flowing through said water supply pipe of steam generated on said heating surface.

11. The steam hairsetter of claim 9 further comprising a water supply pipe for supplying said predetermined amount of water to said heating surface, said water supply pipe having a V-shaped groove on the inner surface thereof such that water can flow to the surface smoothly therethrough.

12. The steam hairsetter of claim 1 further comprising a spring which supports said curler table, normally maintaining said curler table at said normal position.

13. The steam hairsetter of claim 9 wherein said mechanism includes a lever rotatably supported around an axis, one end of said lever being in contact with said curler table and the other end thereof being in force-communicating relationship with said valve.

14. The steam hairsetter of claim 9 wherein said tank is provided with a ventilation hole for air and float located immediately below said ventilation hole such that a water pressure is applied to said float to close said ventilation hole when said piston moves inside said cylinder to increase pressure inside said cylinder.

* * * * *